United States Patent [19]

Wolf

[11] Patent Number: 4,905,750

[45] Date of Patent: Mar. 6, 1990

[54] REINFORCED CERAMIC PASSAGEWAY FORMING MEMBER

[75] Inventor: Walter S. Wolf, Pembroke Pines, Fla.

[73] Assignee: Amcast Industrial Corporation, Kettering, Ohio

[21] Appl. No.: 238,552

[22] Filed: Aug. 30, 1988

[51] Int. Cl.[4] ..... B22C 9/04

[52] U.S. Cl. ..... 164/35; 164/45; 164/132; 164/246; 164/249

[58] Field of Search ..... 164/23, 34, 35, 36, 164/45, 132, 246, 249, 367, 368, 369, 370; 249/61, 62

[56] References Cited

U.S. PATENT DOCUMENTS

| | | | |
|---|---|---|---|
| 2,752,652 | 7/1956 | Hurley | 164/23 |
| 2,752,653 | 7/1956 | Emblem et al. | 164/45 |
| 4,637,449 | 1/1987 | Mills et al. | 164/132 |

*Primary Examiner*—Richard K. Seidel

*Attorney, Agent, or Firm*—Jack E. Dominik

[57] ABSTRACT

The forming of a wax or sacrificial pattern for investment castings in which the interior ceramic reinforced passageway forming elements are reinforced with a metallic wire, and sheathed in a quartz material is disclosed. Thereafter the wire and quartz serve as a reinforced core around which the ceramic is molded to the configuration of the passageway, and in addition containing the positioning elements for mating engagement with the wax injection die at each end of the passage forming part. The method of forming the pattern for injection molding involves the steps of first determining the passage locations, and thereafter forming a reinforced passage ceramic forming member to be positioned interiorly of the pattern. The wax injection die is formed with mating elements to support the ceramic passage forming members. Thereafter the mold is filled with sequential layers of ceramic, and fired. Once the mold is fired and it is totally de-waxed, it is then available for investment casting in the state-of-the-art fashion by pouring or teeming the metal into the investment casting.

8 Claims, 1 Drawing Sheet

REINFORCED CERAMIC PASSAGEWAY FORMING MEMBER

FIELD OF THE INVENTION

The present invention relates to the field of investment casting. More specifically it relates to a method and a pattern which is useful in developing complex castings where an interior passageway is necessary. The interior passageway is formed by means of a ceramic insert which is positioned within a wax mold which, in turn, is encased in a ceramic shell which normally constitutes several layers.

SUMMARY OF THE PRIOR ART

In connection with the preparation of investment castings of the prior art, particularly where passageways must be interior of the casting, a ceramic passageway forming insert is positioned interiorly of the wax pattern for the product. Investment casting contemplates the sacrificing of the pattern which is identical in form and content to the finished part. In some instances, however, in applying the thin coat of ceramic and subsequent coats of ceramic to the sacrificial part in order to make the mold, interior areas cannot be sprayed. Where the interior areas require a passageway, for example, of one-quarter of an inch thickness and perhaps three-quarters of an inch in width and three to five inches long, a ceramic form is made to be positioned interiorly of the wax pattern. These ceramic forms, in turn, are positioned within the wax injection die to take the location where the passageway is desired in the finished part.

Once the entirety of the ceramic passage forming elements and the wax has been formed, it is thereafter encased in several layers of ceramic, and the ceramic is fired. When the exterior shell of the ceramic is fired, the wax of the principal form of the casting disappears, whether by melt-out, burning, or a combination of the above. Indeed, in some instances a different type of pattern material is employed and such materials can be dissolved out with various chemicals.

Many of the castings such as contemplated by the present invention in 1988 dollars cost from $1,000 to $3,000 . A single broken passageway forming part can totally scrap the end result. Oftentimes the deformed, broken, or disoriented ceramic-forming passageway cannot be detected until the final casting is at hand. Even if it can be detected in the pattern configuration, there is still a significant loss in the time and material devoted to forming the pattern.

SUMMARY OF THE PRESENT INVENTION:

The present invention derives from the forming of a wax of sacrificial pattern for investment castings in which the interior ceramic reinforced passageway forming elements are reinforced with a metallic wire, and sheathed in a quartz material. Thereafter the wire and quartz serve as a reinforced core around which the ceramic is molded to the configuration of the passageway, and in addition containing the positioning elements for mating engagement with the wax injection die at each end of the passage forming part. The method of forming the pattern for injection molding involves the steps of first determining the passage locations, and thereafter forming a reinforced passage ceramic forming member to be positioned interiorly of the pattern. The wax injection die is formed with mating elements to support the ceramic passage forming members. Thereafter the mold is filled with sequential layers of ceramic, and fired. Once the mold is fired and it is totally dewaxed, it is then available for investment casting in the state-of-the-art fashion by pouring or teeming the metal into the investment casting.

In view of the above, it is a principal object of the present invention to develop a wax of sacrificial pattern for use in an investment casting process in which ceramic reinforced elements are used for passageway forming portions of the pattern.

A major object of the invention is to provide such reinforced passage forming members which, if subjected to thermal shock, and the other abuses inherent in and essentially incapable of elimination from the investment casting process, which will nontheless reduce the scrap loss in developing the pattern and casting the part to an irreduceable minimum.

Another object of the present invention looks to the formation of passageway ceramic reinforced elements which does not significantly increase the cost of the pattern, but conversely is highly cost-effective when compared with the scrap loss normally experienced in a shop.

Yet another and important object of the present invention is to provide a method and apparatus for forming a pattern with reinforced passageway forming elements which can be, with minimal additional instruction, implemented by persons skilled in the forming of wax patterns for use in investment casting.

BRIEF DESCRIPTION OF THE DRAWINGS:

Further objects and advantages of the present invention will become apparent as the following description of an illustrative embodiment of the pattern and method proceeds, taken in conjunction with the accompanying drawings, in which.

Figure 1:
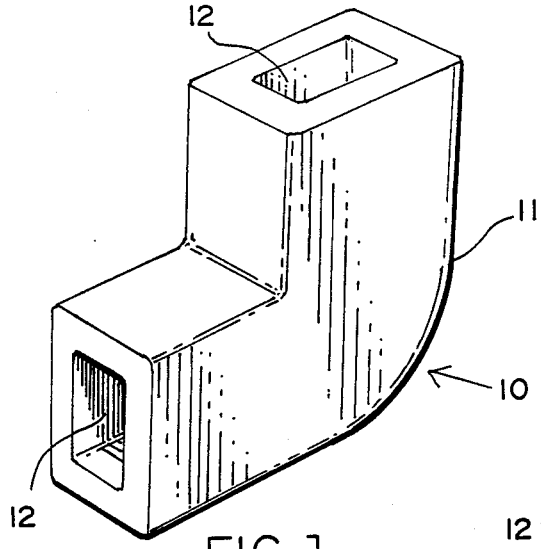
FIG. 1 is an enlarged view perspectively of a pattern typical of that contemplated by the present invention.
Figure 2:
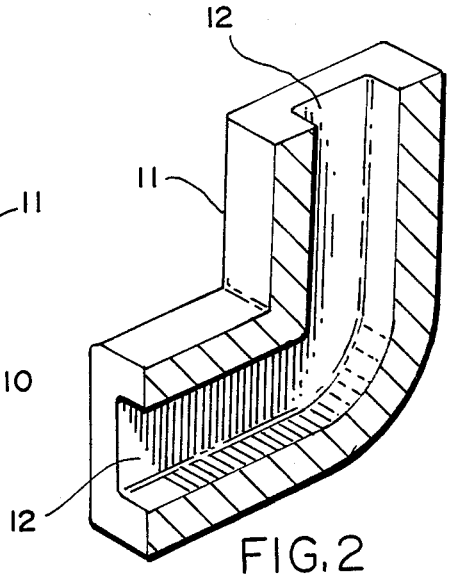
FIG. 2 is a sectional view of the pattern of FIG. 1 taken along section line 2—2 of FIG. 1.

DETAILED DESCRIPTION OF A PREFERRED EMBODIMENT:

Turning now to FIG. 1, it will be seen that a casting is contemplated which is symmetrical about a vertical axis, and has a passageway which is essentially rectangular in cross-section although the dimensions at various levels can change. With circular members and circular cross-sections, comparable forms result. Interiorly of the casting pattern 10 as shown in FIG. 1, passageways 12 are formed. These passageways 12, as readily seen from FIGS. 1 and 2, are hidden on the inside of the casting to the point where traditional investment casting techniques cannot form the passageway, and therefore a forming member is required.

Figure 3:
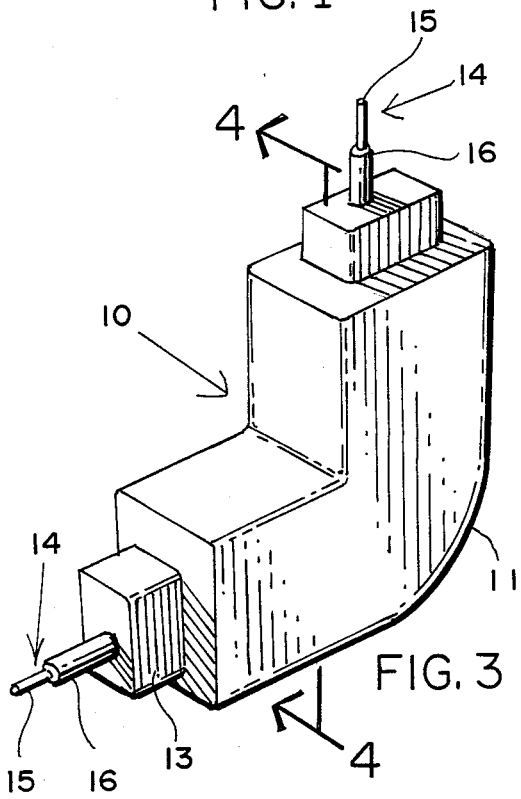
FIG. 3 is a perspective view of a typical forming passage member of the present invention.
Figure 4:
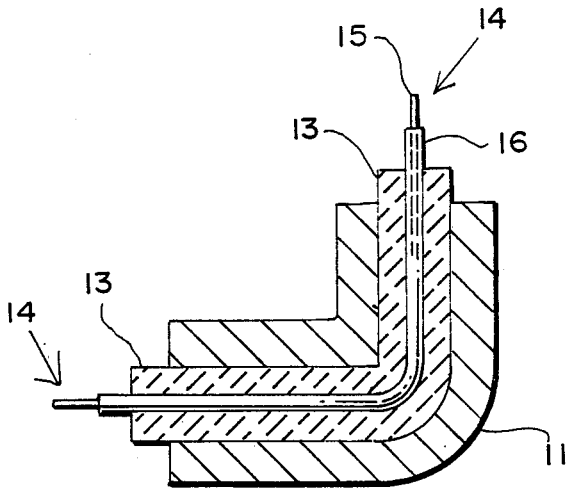
FIG. 4 is a transverse sectional view of the passage forming member of FIG. 3, showing interiorly the passageway.
Figure 5:
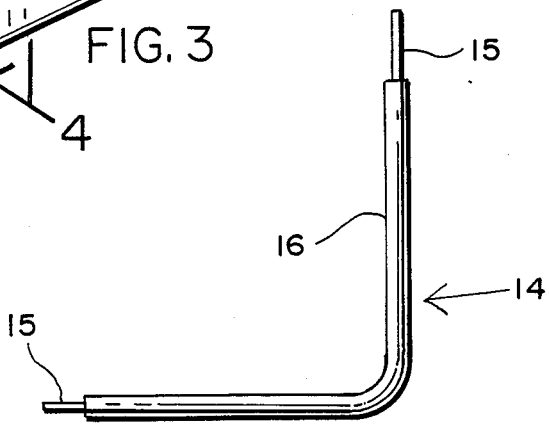
FIG. 5 is a typical plan view of a quartz stainless steel inserted reinforcing member for use in developing the casting of the ceramic passageway forming member of FIGS. 3 and 4 above.

The forming member 14, as shown in FIGS. 3 and 4, takes the configuration of the passageway. This part is to remain interiorly of the injection mold after the mold has been dewaxed. The ceramic part actually forms the passageway. After the investment casting has cooled, the ceramic part can be removed by hydraulic pressure, or with certain chemicals such as hydrofluoric acid which will readily attack the silicon and ceramic, and yet which is relatively inert to the aluminum host of the casting.

The entire ceramic reinforced passage forming member 14 is made from a central wire 15 encased in a quartz tube 16 and surrounded by a cast ceramic 13.

In connection with the present invention and a specific example, a wire of annealed stainless 302 having a diameter of approximately 0.015 inches reinforces the ceramic passageway forming member. The quartz tube into which the wire is inserted, is a high temperature quartz and typically has an outside diameter of 0.070 inches, and an inside diameter of 0.03 inches. These dimensions are not hard and fast, but as a general rule, the wire should be as large as possible with regard to the interior diameter of the quartz, but nonetheless commensurate with being able to insert the wire from the one end or the other of the tubular quartz without fracturing the same. The metal wire should have a higher coefficient of expansion than the ceramic member. The wire floats within the quartz tube so that the wire can expand without fracturing the ceramic member.

A typical casting forming member (image of part to be cast) such as shown essentially in FIG. 1 is approximately 4 to 12 inches high and 10 to 20 inches in diameter, and will weigh anywhere from 15 pounds to 50 pounds. Exemplary products such as helicopter hubs are made by this process. The material typically used is aluminum and its various alloys exemplary of which are the following: C355, A356, A357, A201, A206, and D712. Insofar as the wax is concerned, various types are also employed so long as they are castable, and as long as the mold can be readily dewaxed. Any filled (plastic) or non-filled injection wax is practicable in the development of this product. As to the ceramic part, we have already described the type of wire and quartz tubing. The refractory which is cast around the reinforced quartz tubing is essentially of coloidal silica or ethyl silicate based compositions.

When the ceramic passage forming part 13 is actually made, the wire reinforced quartz tubing 16 is positioned interiorly for the passage forming member. Thereafter the ceramic material is injected thereabout and permitted to take a form. Once the form has "cured" and is no longer "green", it can be fired at anywhere from 1,500° F. to 2,000° F. during a period of time of 240 to 480 minutes. Subsequently the passage forming part (not shown) is provided with locators desirable at both ends.

In summary, the method and pattern referred to above rely upon a reinforced quartz or equivalent tubing and interior annealed stainless steel wire or equivalent which give them dimensional and thermal stability, and more importantly the capability of holding the exterior ceramic in position and to given tolerances during the dewaxing phase of developing the mold, and thereafter during the injection and casting into the mold of the metal intended.

Although particular embodiments of the invention have been shown and described in full here, there is no intention to thereby limit the invention to the details of such embodiments. On the contrary, the intention is to cover all modifications, alternatives, embodiments, usages and equivalents as fall within the spirit and scope of the present invention, specification and appended claims.

What is claimed is:

1. A sacrificial wax pattern for use in investment casting, comprising, in combination, a wax body product forming member, a ceramic reinforced passageway forming element positioned interiorly of said sacrificial pattern, such ceramic reinforced passageway forming member having a reinforced central core, said central reinforcing core being characterized by a single interior wire, and by a quartz tubular member, said wire and said member bent to the central axis of the ceramic passageway forming part and submerged interiorly of the ceramic forming the ceramic interior passageway forming elements.

2. In the pattern of claim 1 above, said reinforcing interior portion being an annealed stainless steel, said annealed stainless steel being positioned interiorly of a high temperature quartz tube.

3. In the pattern of claim 1 above, said ceramic reinforced member being characterized by a ceramic selected from the following: coloidal silica, ethyl silicate, and colloidal silica combined with ethyl silicate.

4. In the pattern of claim 1 above, said wax being any castable heat degradable wax.

5. A method of casting comprising:

determining at least one passageway shape and configuration, forming a reinforced, ceramic passageway forming member complementary to each said passageway, said forming member comprising an interior reinforcement including a wire bent to the approximate configuration of the passageway, said wire encased in high temperature quartz, positioning said passageway forming member in a mold and filling said mold with wax to embed said member therein, creating a wax pattern with extremities of passageway forming member exposed, forming a ceramic shell around said wax pattern with the extremities of the passageway forming member in direct contact with a surrounding ceramic shell to locate and support said passageway forming member, dewaxing the ceramic shell and firing the same, and casting molten metal into the shell mold.

6. In the method of claim 5 above, after the metal has solidified, removing the ceramic reinforced passageway forming element.

7. In the method of claim 5 above, removing said ceramic reinforced passageway forming element by the utilization of hydraulic pressure directed to the passageways.

8. In the method of claim 5 above, removing the ceramic reinforced passageway forming element by dissolving the same in a derivative of hydruofloric acid.

* * * * *